US008939342B2

(12) United States Patent
Brendel et al.

(10) Patent No.: US 8,939,342 B2
(45) **Date of Patent: *Jan. 27, 2015**

(54) CORDLESS FRAMING NAILER

(71) Applicant: Black & Decker Inc., Newark, DE (US)

(72) Inventors: Lee M. Brendel, Bel Air, MD (US); Paul G. Gross, White Marsh, MD (US); Larry E. Gregory, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/947,192

(22) Filed: Jul. 22, 2013

(65) Prior Publication Data

US 2013/0299548 A1 Nov. 14, 2013

Related U.S. Application Data

(63) Continuation of application No. 12/417,242, filed on Apr. 2, 2009, now Pat. No. 8,534,527.

(60) Provisional application No. 61/041,946, filed on Apr. 3, 2008.

(51) Int. Cl.

| | |
|---|---|
| ***B25C 5/02*** | (2006.01) |
| ***B25C 5/06*** | (2006.01) |
| ***B25C 1/00*** | (2006.01) |
| ***B27F 7/00*** | (2006.01) |
| ***B25C 5/15*** | (2006.01) |
| ***B25C 1/06*** | (2006.01) |

(52) U.S. Cl.

CPC .... *B25C 1/06* (2013.01); *B25C 5/15* (2013.01)
USPC ..... 227/134; 227/132

(58) Field of Classification Search

USPC ..... 227/107–139; 173/31, 90–118, 173/200–201, 204, 211; 279/69; 408/138
See application file for complete search history.

(56) References Cited

U.S. PATENT DOCUMENTS

| | | | |
|---|---|---|---|
| 1,945,892 | A | 2/1934 | Gobin |
| 2,069,042 | A | 1/1937 | Marchant |
| 2,593,715 | A | 4/1952 | Adler |
| 2,852,424 | A | 9/1958 | Reinhart |
| 3,305,156 | A | 2/1967 | Khan |
| 3,378,426 | A | 4/1968 | Medney |
| 3,500,940 | A | 3/1970 | Guest |
| 3,768,577 | A | 10/1973 | Leoni |
| 3,854,537 | A | 12/1974 | Nelmark et al. |
| 3,891,036 | A | 6/1975 | Schmidt |
| 3,930,297 | A | 1/1976 | Potucek et al. |
| 3,937,286 | A | 2/1976 | Wagner |
| 4,042,036 | A | 8/1977 | Smith et al. |

(Continued)

FOREIGN PATENT DOCUMENTS

EP 2230050 A1 9/2010

OTHER PUBLICATIONS

Merriam-Webster Encyclopedia Britannica Company & The Free Dictionary by Farlex, definitions for "spring."

*Primary Examiner* — Robert Long
(74) *Attorney, Agent, or Firm* — Harness, Dickey & Pierce, P.L.C.

(57) ABSTRACT

A driving tool with a driver and a motor-driven flywheel that can be engaged by the driver to propel the driver along a driver axis. The driving tool includes a return mechanism with a rail onto which the driver is received. The rail extends parallel to the driver axis.

28 Claims, 15 Drawing Sheets

(56) References Cited

U.S. PATENT DOCUMENTS

| | | | | |
|---|---|---|---|---|
| 4,121,745 | A | 10/1978 | Smith et al. | |
| 4,129,240 | A | 12/1978 | Geist | |
| 4,189,080 | A | 2/1980 | Smith et al. | |
| 4,204,622 | A | 5/1980 | Smith et al. | |
| 4,215,808 | A | 8/1980 | Sollberger et al. | |
| 4,323,127 | A | 4/1982 | Cunningham | |
| 4,434,121 | A | 2/1984 | Sch/a/per | |
| 4,473,217 | A | 9/1984 | Hashimoto | |
| 4,519,535 | A | 5/1985 | Crutcher | |
| 4,530,454 | A | 7/1985 | Gloor et al. | |
| 4,544,090 | A | 10/1985 | Warman et al. | |
| 4,558,747 | A | 12/1985 | Cunningham | |
| 4,721,170 | A | 1/1988 | Rees | |
| 4,724,992 | A | 2/1988 | Ohmori | |
| 4,756,602 | A | 7/1988 | Southwell et al. | |
| 4,773,633 | A | 9/1988 | Hinz et al. | |
| 4,928,868 | A | 5/1990 | Kerrigan | |
| 4,938,297 | A | 7/1990 | Schmidt et al. | |
| 4,964,558 | A | 10/1990 | Crutcher et al. | |
| 5,069,379 | A | 12/1991 | Kerrigan | |
| 5,088,566 | A | 2/1992 | Gustafsson et al. | |
| 5,098,004 | A | 3/1992 | Kerrigan | |
| 5,343,962 | A | 9/1994 | Daigle et al. | |
| 5,445,227 | A | 8/1995 | Heppner | |
| 5,511,715 | A | 4/1996 | Crutcher et al. | |
| 5,802,691 | A | 9/1998 | Zoltaszek | |
| 5,975,217 | A | 11/1999 | Frenzel et al. | |
| 5,992,541 | A | 11/1999 | Frenzel et al. | |
| 6,000,477 | A | 12/1999 | Campling et al. | |
| 6,068,250 | A | 5/2000 | Hawkins et al. | |
| 6,315,059 | B1 | 11/2001 | Geldean | |
| 6,454,251 | B1 | 9/2002 | Fish | |
| 6,607,111 | B2 | 8/2003 | Garvis et al. | |
| 6,669,072 | B2 | 12/2003 | Burke et al. | |
| 6,729,522 | B2 | 5/2004 | Hempfling et al. | |
| 6,889,591 | B2 | 5/2005 | Sabates et al. | |
| 7,204,403 | B2 | 4/2007 | Kenney et al. | |
| 7,252,157 | B2 | 8/2007 | Aoki | |
| 7,267,257 | B2 | 9/2007 | Erhardt et al. | |
| 7,275,673 | B2 | 10/2007 | Zahner et al. | |
| 7,494,037 | B2 | 2/2009 | Simonelli et al. | |
| 7,503,401 | B2 | 3/2009 | Gross et al. | |
| 7,556,184 | B2 | 7/2009 | Brendel et al. | |
| 7,575,141 | B1 | 8/2009 | Liang et al. | |
| 7,575,142 | B2 | 8/2009 | Liang et al. | |
| 7,789,169 | B2 | 9/2010 | Berry et al. | |
| 8,142,365 | B2 | 3/2012 | Miller | |
| 8,302,833 | B2 | 11/2012 | Gross et al. | |
| 8,511,532 | B2 * | 8/2013 | Chien et al. | 227/133 |
| 2002/0003045 | A1 | 1/2002 | Bongers-Ambrosius | |
| 2002/0108993 | A1 | 8/2002 | Harper et al. | |
| 2002/0108994 | A1 | 8/2002 | Burke et al. | |
| 2002/0108995 | A1 | 8/2002 | Hempfling et al. | |
| 2002/0185288 | A1 | 12/2002 | Hanke et al. | |
| 2003/0221847 | A1 | 12/2003 | Funfer | |
| 2005/0072584 | A1 | 4/2005 | Dresig et al. | |
| 2005/0217873 | A1 * | 10/2005 | Gross et al. | 173/1 |
| 2005/0218177 | A1 | 10/2005 | Berry et al. | |
| 2005/0218178 | A1 | 10/2005 | Berry et al. | |
| 2005/0218182 | A1 | 10/2005 | Berry et al. | |
| 2005/0218183 | A1 | 10/2005 | Berry et al. | |
| 2006/0076154 | A1 | 4/2006 | Aoki | |
| 2006/0175373 | A1 | 8/2006 | Erhardt et al. | |
| 2007/0102471 | A1 | 5/2007 | Gross et al. | |
| 2007/0210133 | A1 * | 9/2007 | Oda et al. | 227/131 |
| 2008/0048000 | A1 | 2/2008 | Simonelli et al. | |
| 2008/0105725 | A1 | 5/2008 | Tamura et al. | |
| 2008/0185164 | A1 | 8/2008 | Amherd | |
| 2008/0217040 | A1 | 9/2008 | Loeffler et al. | |
| 2008/0302852 | A1 | 12/2008 | Brendel et al. | |
| 2009/0223691 | A1 | 9/2009 | Ikuta et al. | |
| 2009/0236387 | A1 | 9/2009 | Simonelli et al. | |
| 2009/0294504 | A1 | 12/2009 | Kunz et al. | |
| 2009/0294505 | A1 | 12/2009 | Kunz et al. | |
| 2010/0175903 | A1 | 7/2010 | Ikuta et al. | |
| 2010/0187280 | A1 | 7/2010 | Akiba et al. | |
| 2012/0097729 | A1 | 4/2012 | Gross et al. | |
| 2013/0233903 | A1 * | 9/2013 | Brendel et al. | 227/129 |

* cited by examiner

CORDLESS FRAMING NAILER

This application is a continuation of U.S. patent application Ser. No. 12/417,242 filed Apr. 2, 2009, which claims the benefit of U.S. Provisional Patent Application No. 61/041,946 filed Apr. 3, 2008. The disclosure of each of the above-mentioned applications is incorporated by reference as if fully set forth in detail herein.

INTRODUCTION

The present invention generally relates to driving tools and more particularly to a driving tool with a driver that can be selectively engaged to a rotating flywheel.

Fastening tools, such as power nailers and staplers, are relatively common place in the construction trades. Often times, however, the fastening tools that are available may not provide the user with a desired degree of flexibility and freedom due to the presence of hoses and such that couple the fastening tool to a source of pneumatic power.

Recently, several types of cordless nailers have been introduced to the market in an effort to satisfy the demands of modern consumers. Some of these nailers, however, are relatively large in size and/or weight, which render them relatively cumbersome to work with. Others require relatively expensive fuel cartridges that are not re-fillable by the user so that when the supply of fuel cartridges has been exhausted, the user must leave the work site to purchase additional fuel cartridges. Yet other cordless nailers are relatively complex in their design and operation so that they are relatively expensive to manufacture and do not operate in a robust manner that reliably sets fasteners into a workpiece in a consistent manner. Accordingly, there remains a need in the art for an improved fastening tool.

SUMMARY

This section provides a general summary of some aspects of the present disclosure and is not a comprehensive listing or detailing of either the full scope of the disclosure or all of the features described therein.

In one form, the present teachings provide a driving tool having a frame, a motor coupled to the frame, a flywheel, a rail, a driver and a follower. The frame defines a rotational axis and a driver axis. The flywheel is rotatably driven by the motor about the rotational axis. The rail extends parallel to the driver axis. The driver is mounted on the rail and movable along the driver axis between a returned position and an extended position. The follower is coupled to the frame and is movable between a first position, in which the follower drives the driver into engagement with the flywheel to transfer energy from the flywheel to the driver to propel the driver along the driver axis, and a second position in which the follower, the driver and the flywheel are not engaged to one another.

In another form, the present teachings provide a driving tool with a frame, a nosepiece, a motor, a flywheel, a pair of rails, a driver, a pair of springs and a follower. The frame defines a rotational axis and a driver axis. The nosepiece is coupled to the frame. The motor is coupled to the frame. The flywheel is rotatably driven by the motor about the rotational axis. The rails extend parallel to the driver axis and are disposed on opposite sides of the flywheel. The driver is mounted on the rails and is received into the nosepiece. The driver is movable along the driver axis between a returned position and an extended position. Each of the springs is received over a corresponding one of the rails and cooperates to bias the driver into the returned position. The follower is coupled to the frame and is movable between a first position, in which the follower drives the driver into engagement with the flywheel to transfer energy from the flywheel to the driver to propel the driver along the driver axis, and a second position in which the follower, the driver and the flywheel are not engaged to one another. The rails are movable relative to the frame in a direction toward the rotational axis when the driver is driven by the follower into engagement with the flywheel.

In a further form, the present teachings provide a driving tool having a motor assembly with an electric motor-driven flywheel, a driver and a follower that is selectively movable to drive the driver into engagement with a rotating perimeter of the flywheel. The driver is unitarily formed and includes driver body and a driver blade. The driver body includes a driver profile on one side, which is configured to engage the perimeter of the flywheel, and a cam on an opposite side that is configured to aid in the loading and unloading of the follower with movement of the driver.

Further areas of applicability will become apparent from the description provided herein. It should be understood that the description and specific examples in this summary are intended for purposes of illustration only and are not intended to limit the scope of the present disclosure, its application and/or uses in any way.

BRIEF DESCRIPTION OF THE DRAWINGS

The drawings described herein are for illustration purposes only and are not intended to limit the scope of the present disclosure in any way.

DETAILED DESCRIPTION OF THE VARIOUS EMBODIMENTS

Overview

Figure 1A:
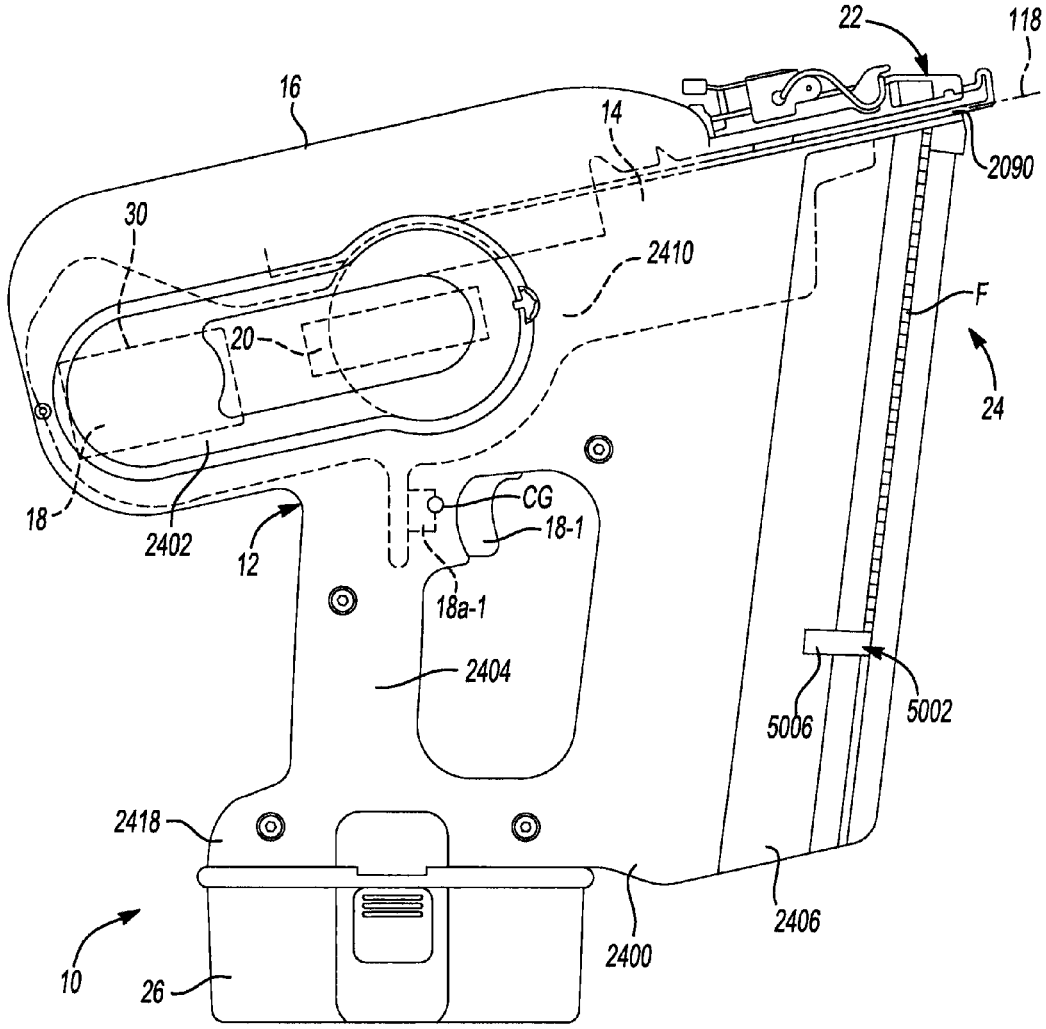
FIG. 1A is a side elevation view of an exemplary driving tool constructed in accordance with the teachings of the present disclosure.
Figure 1B:
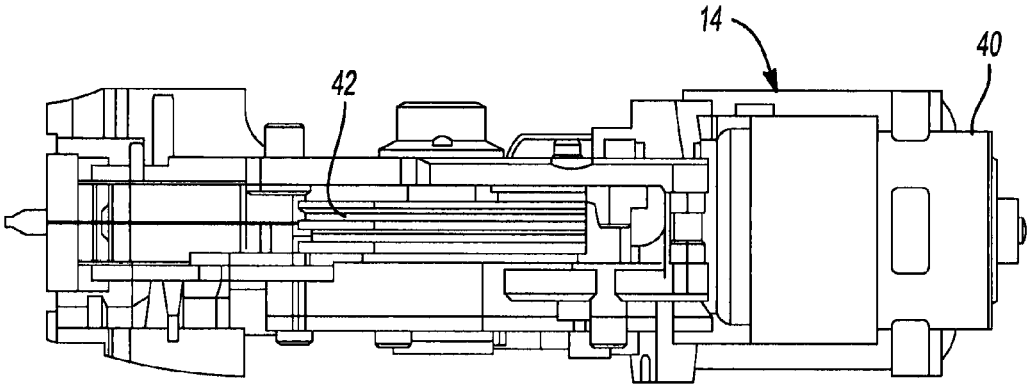
FIG. 1B is a bottom plan view of a portion of the driving tool of FIG. 1 illustrating the backbone and drive motor assembly in more detail.
Figure 1C:
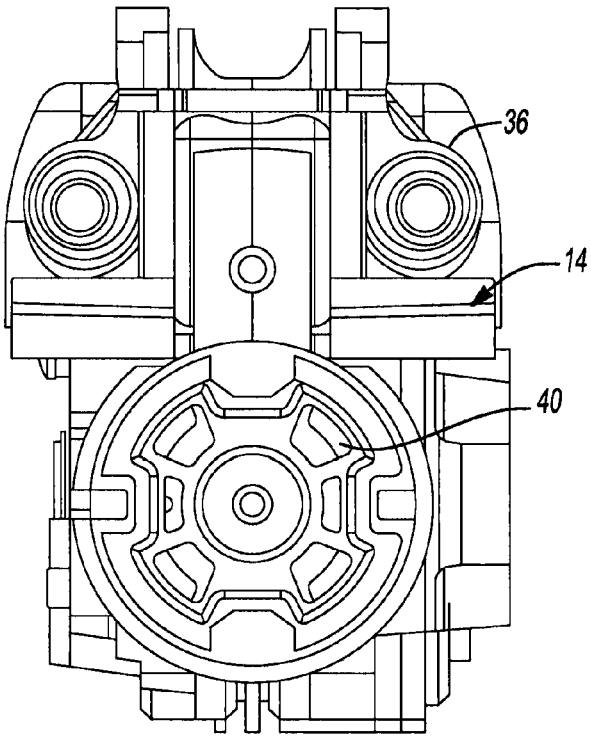
FIG. 1C is a rear view of a portion of the driving tool of FIG. 1 illustrating the backbone and drive motor assembly in more detail.
Figure 1D:
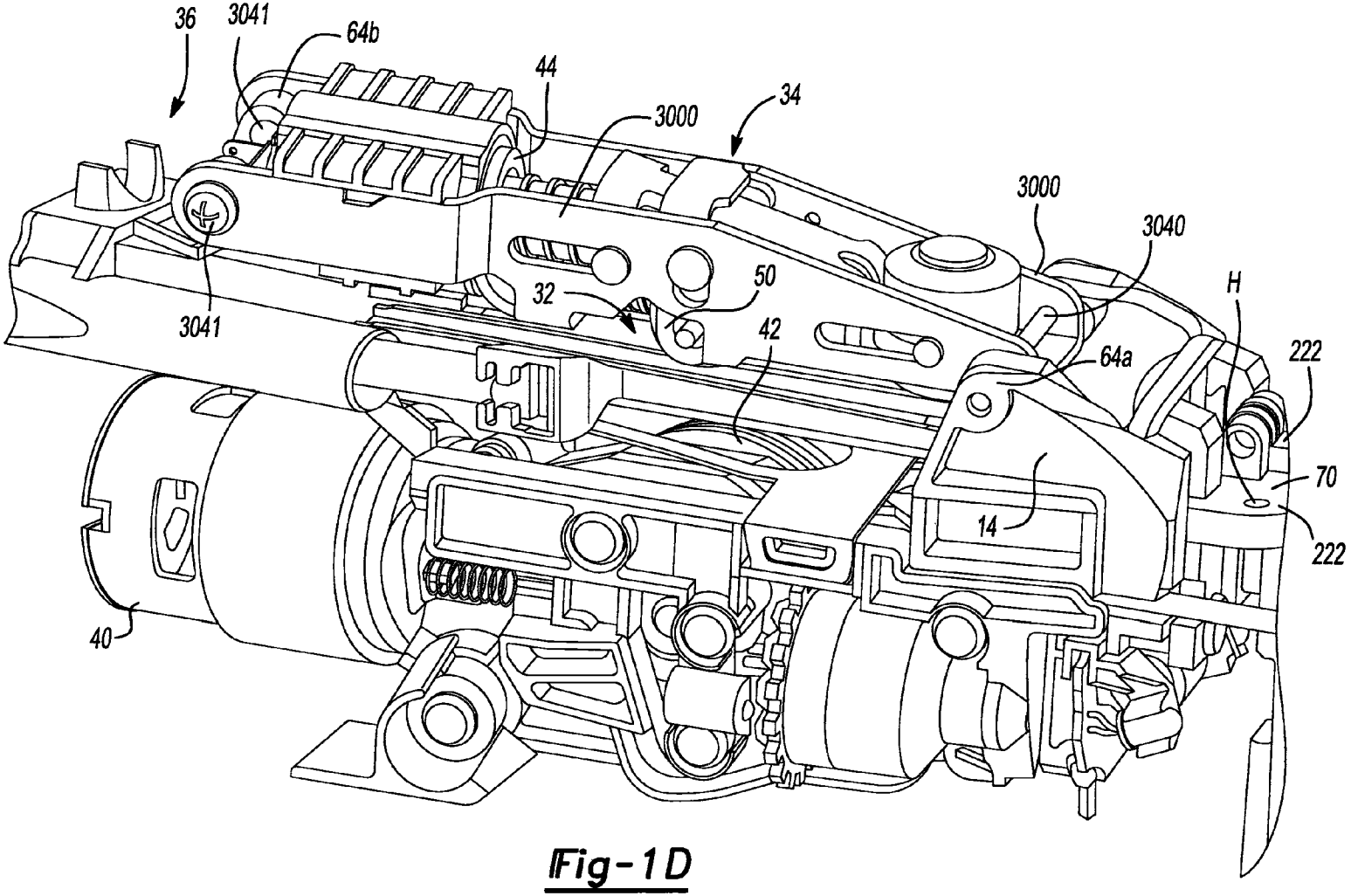
FIG. 1D is a perspective view of a portion of the driving tool of FIG. 1.
Figure 2:
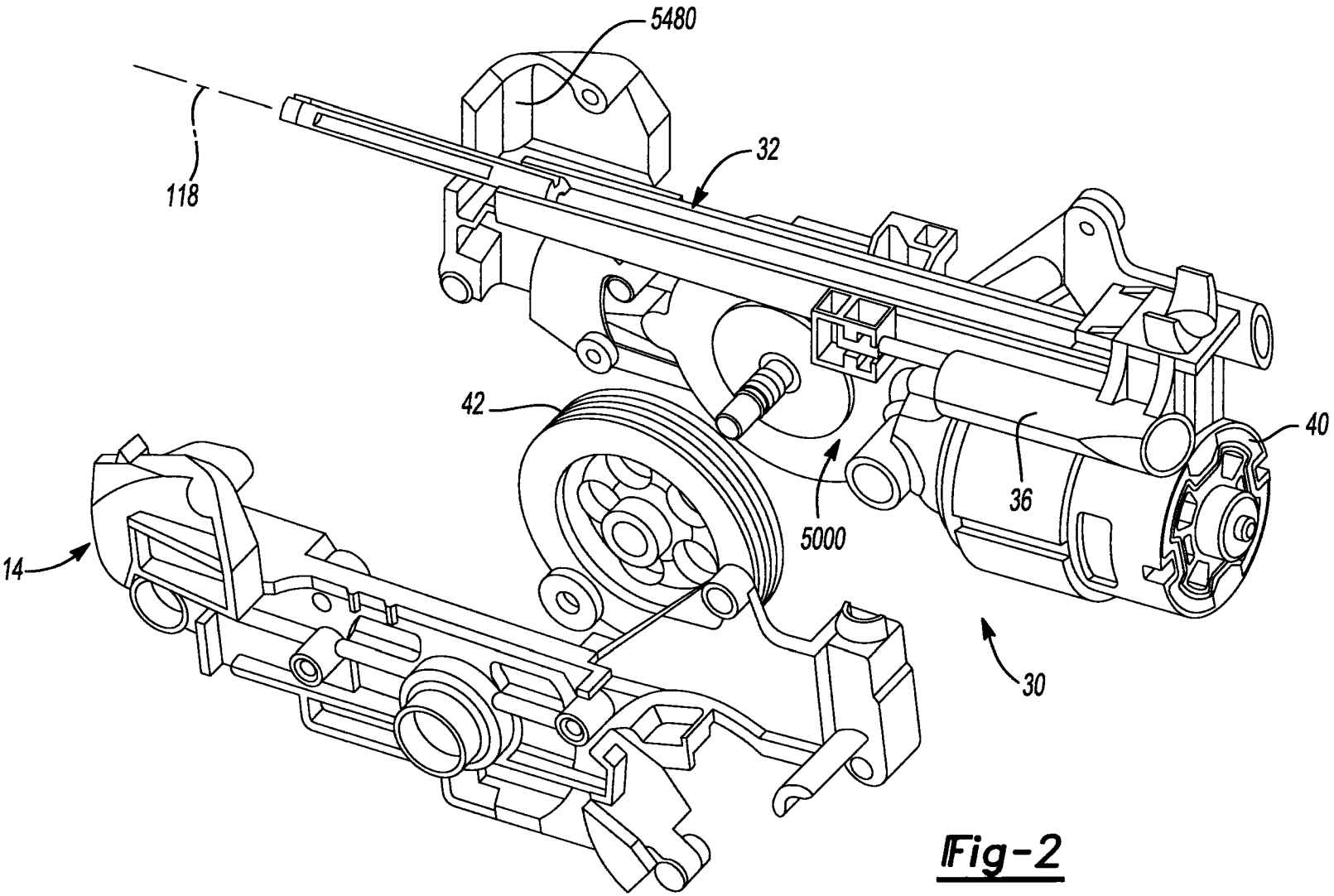
FIG. 2 is an exploded perspective view of a portion of the driving tool of FIG. 1, illustrating the backbone and the power source in more detail.

With reference to FIGS. 1A through 2 of the drawings, a driving tool constructed in accordance with the teachings of the present invention is generally indicated by reference numeral 10. The driving tool 10 may include a housing and magazine assembly 12, a backbone 14, a backbone cover 16, a drive motor assembly 18, a control unit 20, a nosepiece assembly 22 and a battery pack 26. While the driving tool 10 is illustrated as being electrically powered by a suitable power source, such as the battery pack 26, those skilled in the art will appreciate that the invention, in its broader aspects, may be constructed somewhat differently and that aspects of the present invention may have applicability to pneumatically powered driving tools. Furthermore, while aspects of the present invention are described herein and illustrated in the accompanying drawings in the context of a nailer, those of ordinary skill in the art will appreciate that the invention, in its broadest aspects, has further applicability. For example, the drive motor assembly 18 may also be employed in various other mechanisms that utilize reciprocating motion, including rotary hammers, hole forming tools, such as punches, and riveting tools, such as those that install deformation rivets.

Aspects of the control unit 20 and the nosepiece assembly 22 of the particular driving tool illustrated are described in further detail in copending U.S. patent application Ser. No. 11/095,723 filed Mar. 31, 2005, entitled "Method For Controlling A Power Driver" and U.S. patent application Ser. No. 11/068,344 filed Feb. 28, 2005, entitled "Contact Trip Mechanism For Nailer", all of which being incorporated by reference in their entirety as if fully set forth in detail herein. The battery pack 26 may be of any desired type and may be rechargeable, removable and/or disposable. In the particular example provided, the battery pack 26 is rechargeable and removable and may be a battery pack that is commercially available and marketed by the DeWalt Industrial Tool Company of Baltimore, Md.

Those of ordinary skill in the art will appreciate that other aspects of the driving tool 10 that are not described in detail herein can be generally similar to corresponding components illustrated and described in U.S. patent application Ser. No. 11/586,104 entitled "Power Take Off For Cordless Nailer", the disclosure of which is hereby incorporated by reference as if set forth in its entirety herein. For example, the follower assembly 34 can be similar to the follower assembly 34' illustrated and described in U.S. patent application Ser. No. 11/586,104.

The backbone 14 may be a structural element upon which the drive motor assembly 18, the control unit 20, the nosepiece assembly 22, and/or the housing and magazine assembly 12 may be fully or partially mounted. The drive motor assembly 18 may be of any desired configuration, but in the example provided, includes a power source 30, a driver 32, a follower assembly 34, and a return mechanism 36. In the particular example provided, the power source 30 includes a motor 40, a transmission 5000, a flywheel 42, and an actuator 44.

In operation, fasteners F, which are stored in the housing and magazine assembly 12, are sequentially fed into the nosepiece assembly 22. The drive motor assembly 18 may be actuated by the control unit 20 to cause the driver 32 to translate and impact a fastener F that resides in the nosepiece assembly 22 so that the fastener F may be driven into a workpiece (not shown). Actuation of the power source may utilize electrical energy from the battery pack 26 to operate the motor 40 and the actuator 44. The motor 40 is employed to drive the flywheel 42, while the actuator 44 is employed to move a follower 50 that is associated with the follower assembly 34, which squeezes the driver 32 into engagement with the flywheel 42 so that energy may be transferred from the flywheel 42 to the driver 32 to cause the driver 32 to translate. More specifically, the follower 50, which can be a roller, can be coupled to the backbone 14 and can be moved via the actuator 44 between a first position, in which the follower 50 drives the driver 32 into the rotating perimeter of the flywheel 42 to transfer energy from the flywheel 42 to the driver 32 to propel the driver 32 along the driver axis 118, and a second position in which the follower 50, the driver 50 and the flywheel 42 are not engaged to one another. The nosepiece assembly 22 guides the fastener F as it is being driven into the workpiece. The return mechanism 36 biases the driver 32 into a returned position.

Housing & Magazine Assembly

The housing and magazine assembly 12 can include a pair of discrete housing shells 2400 and a pusher assembly 5002. The housing shells 2400 can be formed from a thermoplastic material and can cooperate to define a tool body portion 2402, a handle portion 2404, and a magazine portion 2406. The body portion 2402 may define a housing cavity 2410 that is sized to receive the backbone 14, the drive motor assembly 18 and the control unit 20 therein. The handle portion 2404 may extend from the body portion 2402 and may be configured in a manner that permits an operator to manipulate the driving tool 10 in a convenient manner. The handle portion 2404 may include a mount 2418 to which the battery pack 26 may be releasably coupled. The pusher assembly 5002 can include a spring-biased pusher 5006 that can be housed in the magazine portion 2406. The magazine portion 2406 can cooperate with the pusher assembly 5002 to hold a plurality of fasteners F and sequentially dispense the fasteners F into the nosepiece assembly 22. It will be appreciated that one or more guide rails (not specifically shown), which can be formed of a suitably wear-resistant material, can be coupled to the housing shells 2400 to cover portions of the housing shells 2400 that would otherwise directly contact the fasteners F and/or portions of the pusher assembly 5002 in the magazine portion 2406.

Optionally, portions of the housing shells 2400 can be overmolded to create areas on the exterior of and/or within the housing and magazine assembly 12 that enhance the capability of the housing and magazine assembly 12 to be gripped by an operator, provide vibration damping, and/or form one or more seals. Such techniques are described in more detail in commonly assigned U.S. Pat. No. 6,431,289 entitled "Multi-speed Power Tool Transmission", which is hereby incorporated by reference as if fully set forth in detail herein.

Backbone

Figure 3:
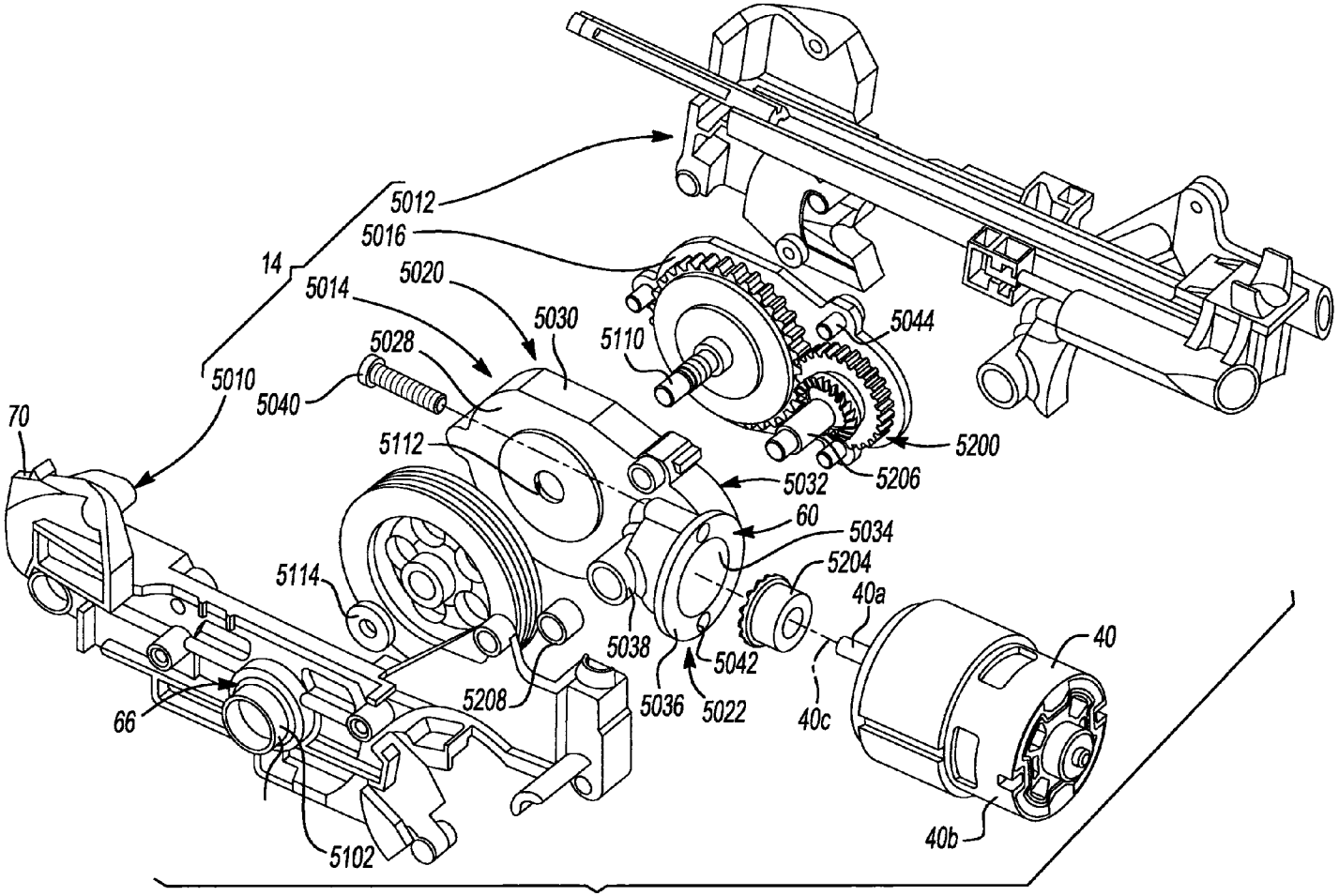
FIG. 3 is an exploded perspective view of a portion of the driving tool of FIG. 1 illustrating the backbone, transmission and motor in more detail.
Figure 4:
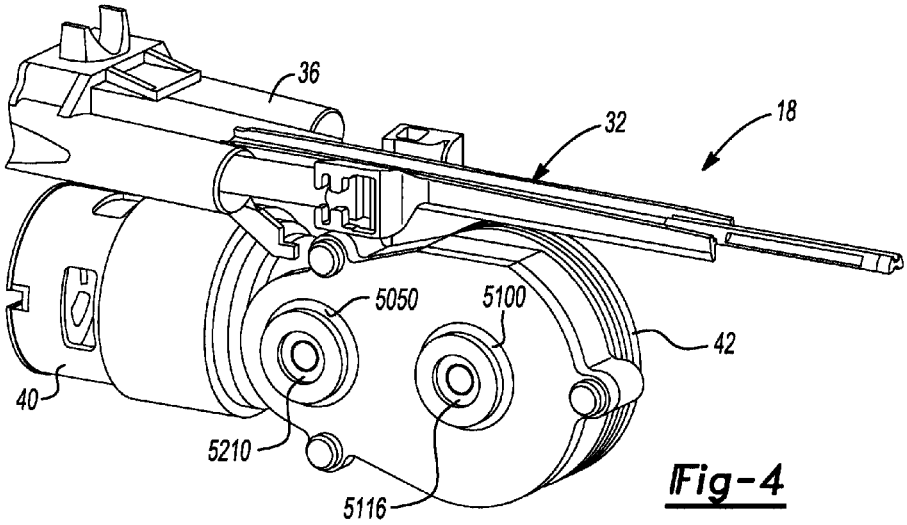
FIG. 4 is a perspective view of a portion of the driving tool of FIG. 1 illustrating the driver and the power source in more detail.

With reference to FIGS. 2 through 4, the backbone 14 can define a motor mount 60, a flywheel mount 66, first and second activation arm mounts 68*a* and 68*b* and a nosepiece mount 70. In the particular example provided, the backbone 14 includes a first backbone member 5010, a second backbone member 5012, a first gearcase member 5014 and a second gearcase member 5016. It will be appreciated that while the first gearcase member 5014 is illustrated and described below as being a discrete component that is coupled to the first and second backbone members 5010 and 5012, the first gearcase member 5014 could be integrally formed with the second backbone member 5012. Each of the first and second backbone members 5010 and 5012 and the first and second gearcase members 5014 and 5016 can be die cast from a suitable structural material, such as magnesium or aluminum.

The first gearcase member 5014 can define a first case portion 5020 and a second case portion 5022 (i.e., the motor mount 60). The first case portion 5020 can include a rear wall 5028 and an annular sidewall 5030 that can be disposed about the outer perimeter of the rear wall 5028. The rear wall 5028 and the annular sidewall 5030 can cooperate to define a gear cavity 5032. The second case portion 5022 can have a hollow semi-spherical shape that can define a mounting aperture 5034, an annular surface 5036 that can be disposed about the mounting aperture 5034, and a first bearing mount 5038. The mounting aperture 5034 can receive at least the output shaft 40*a* of the motor 40. In the particular example provided, the motor 40 is abutted against the annular surface 5036 and threaded fasteners 5040 are received through fastener apertures 5042 in the annular surface 5036 and threadably engaged to corresponding threaded holes (not shown) in the motor 40 to thereby fixedly but removably couple the motor 40 to the motor mount 60. Optionally, one or more spacers (not shown) can be disposed between the annular surface 5036 and the motor 40 to control the position of the motor 40 relative to a datum of the motor mount 60. It will be appreciated that other mounting/alignment techniques may be employed to mount the motor 40 in the motor mount 60 in a desired orientation. For example, the body 40*b* of the motor 40 can be press-fit into the mounting aperture 5034 or threaded into the mounting aperture 5034. Mounting of the motor 40 in the manner illustrated permits the rotational axis 40*c* of the motor 40 to be oriented generally parallel and in a common plane with the axis 118 along which the driver 32 translates to thereby reduce the overall width of the driving tool 10 relative to the width of the driving tool that is illustrated and described in U.S. Pat. No. 7,204,403.

The second gearcase member 5016 can be removably coupled to the first gearcase member 5014 via a plurality of fasteners 5044 to close a side of the gear cavity 5032 opposite the rear wall 5028. The second gearcase member 5016 can define a second bearing mount 5050.

The flywheel mount 66 can include a third bearing mount 5100 in the second gearcase member 5016 and a fourth bearing mount 5102 that can be formed in the first backbone member 5010. A transmission output shaft 5110 can be received through a hole 5112 in the first gearcase member 5014 and supported on bearings 5114 and 5116 that can be received into the third and fourth bearing mounts 5100 and 5102, respectively. The flywheel 42 can be coupled for rotation with the transmission output shaft 5110.

A pin 3040 can be received through the opposite arms 3000 of the follower assembly 34 and into corresponding apertures in the first activation arm mount 64*a* to thereby fixedly couple a first end of the follower assembly 34 to the backbone 14. A pair of threaded fasteners 3041 can be received through the opposite arms 3000 of the follower assembly 34 and into corresponding apertures in the second activation arm mount 64*b* to thereby fixedly couple a second end of the follower assembly 34 to the backbone 14.

The nosepiece mount 70 may include a pair of flanges 220 that can extend outwardly in the direction in which the driver 32 is advanced (or extended). The nosepiece assembly 22 can be coupled to the nosepiece mount 70 in any desired manner. For example, threaded fasteners (not shown) can be received through holes H (only one shown) in the flanges 220 and threadably coupled to the nosepiece assembly 22.

Power Source

The transmission 5000 can be mounted to the backbone 14 and can include a plurality of gears 5200 that transmit rotary power between the output shaft 40*a* of the motor 40 and the output shaft 5110 of the transmission 5000. The plurality of gears 5200 can be of any desired configuration and can include for example spur and/or bevel gears having straight and/or helical teeth. In the particular example illustrated, a bevel pinion 5204 is non-rotatably coupled to the output shaft 40*a* of the motor 40 and received through the mounting aperture 5034 into the hollow interior of the second case portion 5022. An intermediate shaft 5206 can be supported on a pair of bearings 5208 and 5210; each of the bearings 5208 and 5210 is received in an associated one of the first and second bearing mounts 5038 and 5050.

Figure 5:
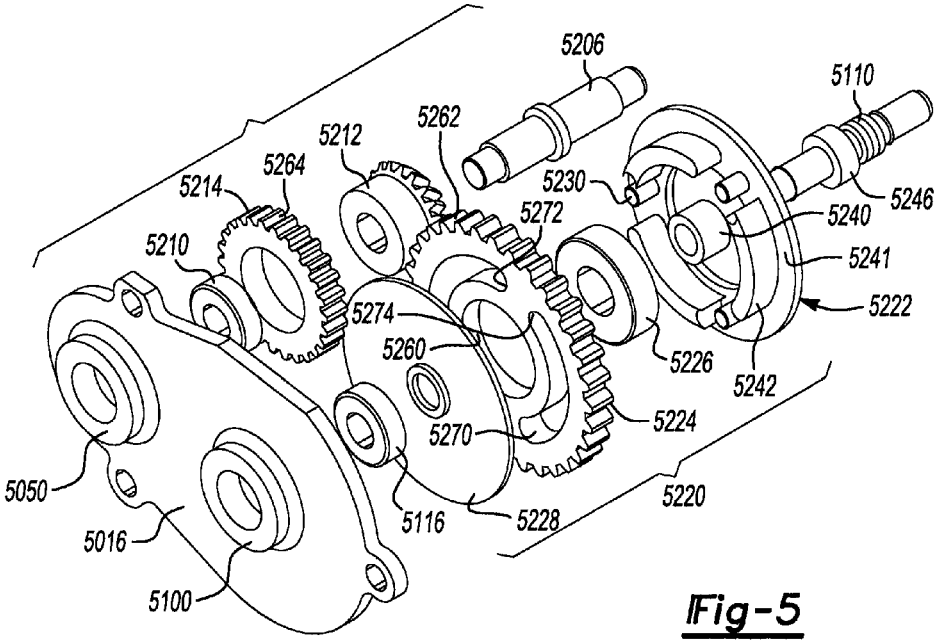
FIG. 5 is an exploded perspective view of a portion of the driving tool of FIG. 1 illustrating the transmission and a second gearcase member in more detail.

With additional reference to FIG. 5, a bevel idler gear 5212 can be received on the intermediate shaft 5206 and meshingly engaged with the bevel pinion 5204. A spur idler gear 5214 can be coupled for rotation with the bevel idler gear 5212.

The transmission output shaft 5110 can be supported on the bearings 5114 and 5116 in the third and fourth bearing mounts 5100 and 5102, respectively. An output gear assembly 5220 can be mounted on the transmission output shaft 5110 and can be meshingly engaged with the spur idler gear 5214. The output gear assembly 5220 can include an isolation plate 5222, an output spur gear 5224, a bearing 5226, a plate member 5228 and a plurality of isolation plugs 5230. The isolation plate 5222 can include a hub 5240, an annular plate member 5241 that can be coupled to and extend outwardly from the hub 5240, and a plurality of arcuate lugs 5242. The hub 5240 can be configured to mount the isolation plate 5222 to the transmission output shaft 5110 in any desired manner, such as via an interference fit (e.g., press fit) that involves an aperture 5244 in the hub 5240 and the outer diameter of the portion of the transmission output shaft 5110 to which the hub 5240 is coupled. It will be appreciated that various features, such as a shoulder 5246, can be incorporated into the transmission output shaft 5110 and/or the isolation plate 5222 so that these components can be joined to one another in a desired manner. For example, the isolation plate 5222 may be pressed onto the transmission output shaft 5110 such that the hub 5240 is abutted against the shoulder 5246.

Figure 6:
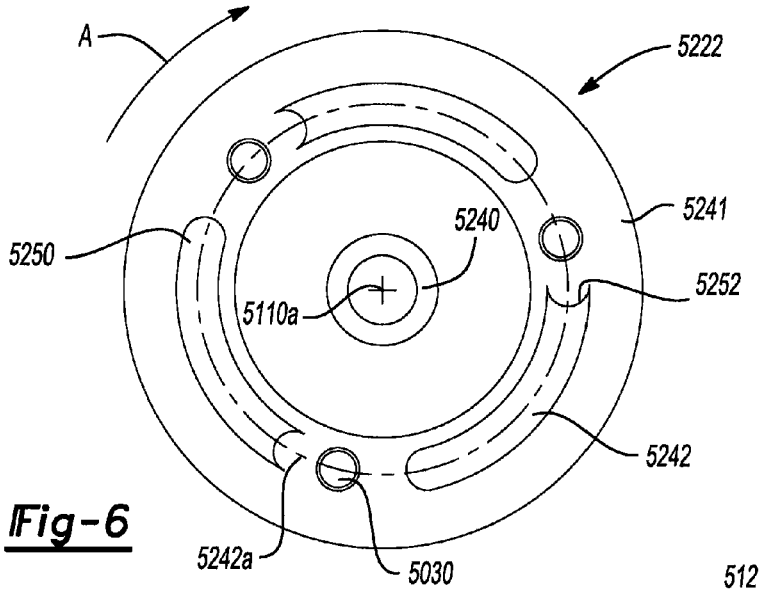
FIG. 6 is an end view of a portion of the driving tool of FIG. 1 illustrating the construction of the lug members on the isolation plate of the transmission.

With additional reference to FIG. 6, the arcuate lugs 5242 can extend from a side of the annular plate member 5241 and can be disposed about a common (circular) axis 5242*a* about a rotational axis 5110*a* of the transmission output shaft 5110.

Each of the arcuate lugs 5242 can include a first end 5250, which can be defined by a radius (whose center point can lie on the common circular axis 5242*a*) and can have a convex cylindrical shape, and a second end 5252 opposite the first end 5250, which can be defined by a radius (whose center point can lie on the common circular axis 5242*a*) and can have a concave cylindrical shape.

The output spur gear 5224 can include a through-hole 5260, a plurality of teeth 5262 that can be meshingly engaged to the teeth 5264 of the spur idler gear 5214, and a plurality of arcuate slots 5270 that can be configured to receive the arcuate lugs 5242 of the isolation plate 5222. Each of the arcuate slots 5270 can have a first end 5272, which can be complementary in shape to the first end 5250 of the arcuate lugs 5242, and a second end 5274 opposite the first end 5272. The bearing 5226 can be received between the transmission output shaft 5110 and the output spur gear 5224 so as to support the output spur gear 5224 for rotation on the transmission output shaft 5110. The plate member 5228 can be received on the transmission output shaft 5110 on a side of the output spur gear 5224 opposite the annular plate member 5228 of the isolation plate 5222. Each of the isolation plugs 5230 can be formed of a resilient material. Each isolation plug 5230 can be generally cylindrical in shape and can be received between the concave second end 5252 of an associated one of the arcuate lugs 5242 and a second end 5274 of an associated one of the arcuate slots 5270. It will be appreciated that the shape of the second end 5274 of the arcuate slots 5270 and the portion of the isolation plugs 5230 that contact the second end 5274 of the arcuate slots 5270 can be configured in any desired manner and can be sized and shaped to inhibit rotational movement of one or more of the isolation plugs 5230 relative to the output spur gear 5224 (e.g., the second end 5274 of the arcuate slot 5270 could include a "bow-tie" or "dog bone" shape and the isolation plugs 5230 could be shaped to resiliently engage such "bow-tie" or "dog bone" shape).

Power can be transmitted through the transmission 5000 such that the output spur gear 5224 is rotated in a direction that tends to compress the isolation plugs 5230 against the second ends 5252 of the arcuate lugs 5242 (i.e., in the direction of arrow A in FIG. 6). The isolation plugs 5230 can be configured to further compress when the rotational inertia of the transmission 5000 is greater than the rotational inertia of the flywheel 42 (e.g., upon start-up of the motor 40 or after the flywheel 42 has decelerated due to transmission of energy to the driver 32). In such situations, the compliant nature of the isolation plugs 5230 serves to relieve some of the stress on the teeth 5262 of the output spur gear 5224.

Figure 5A:
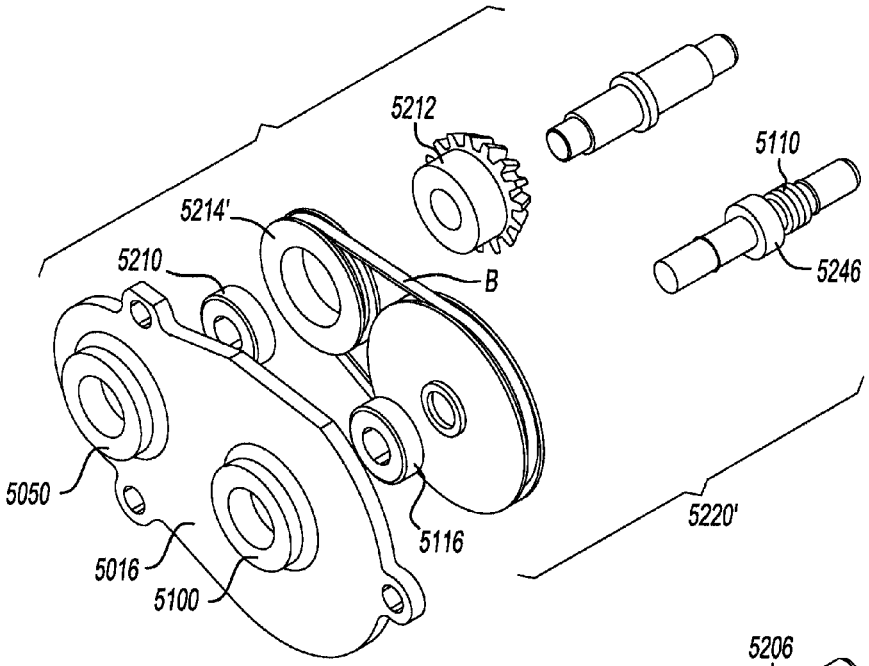
FIGS. 5A and 5B are exploded perspective views similar to that of FIG. 5 but illustrating alternatively configured transmissions that utilize pulleys and a power transmitting belt.
Figure 5B:
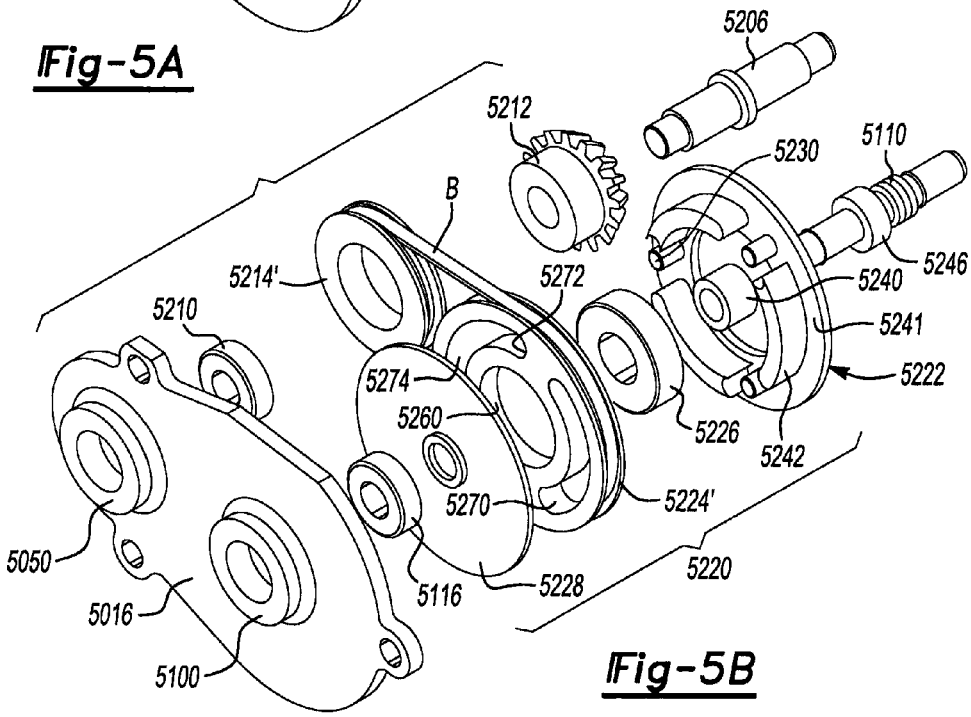

While the transmission 5000 has been illustrated and described as including a spur idler gear 5214 and an output gear assembly 5220, those of skill in the art will appreciate that the transmission could be configured somewhat differently. For example, the transmission 5000' of FIG. 5A substitutes a pair of pulleys 5214' and 5220' and a belt B for the spur idler gear 5214 and the output gear assembly 5220 of FIG. 5, while the transmission 5000" of FIG. 5B substitutes a pair of pulleys 5214' and 5224' and a belt B for the spur idler gear 5214 and the output spur gear 5224 of FIG. 5.

Driver

Figure 7:
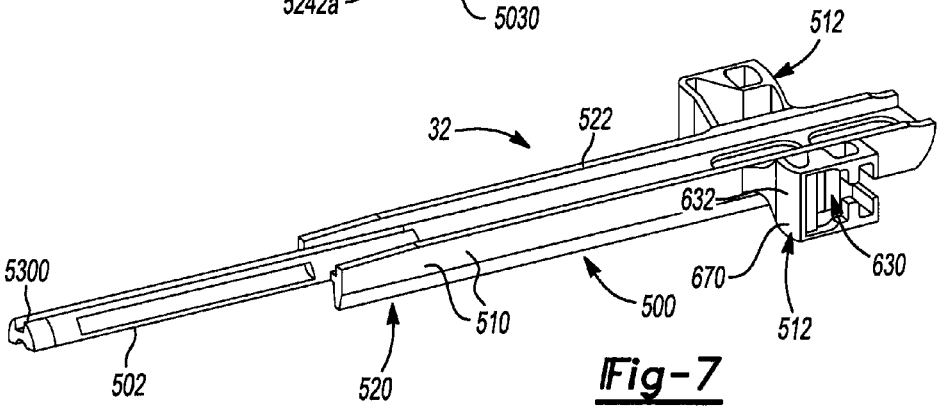
FIG. 7 is a perspective view of a portion of the power source illustrating the driver in more detail.
Figure 8:
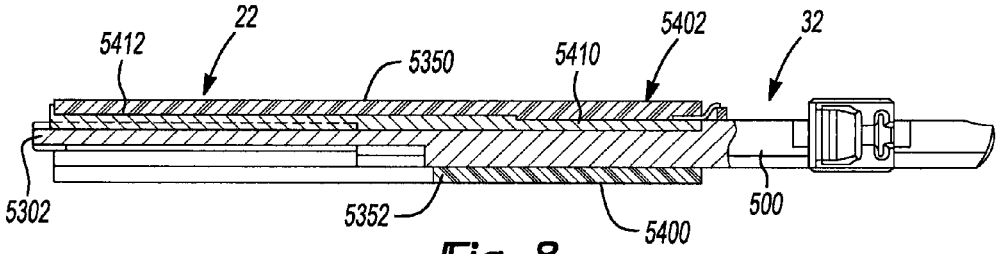
FIG. 8 is a section view of a portion of the driving tool of FIG. 1 illustrating the driver as received into the nosepiece assembly.

With reference to FIGS. 4, 7 and 8, the driver 32 can be unitarily formed in a suitable casting process (e.g., investment casting) from a suitable material, such as steel. The driver 32 can include an upper driver member 500 and a driver blade 502. The upper driver member 500 can include a body 510 and a pair of projections 512. The projections 515 can extend from the opposite lateral sides of the body 510 and can include return anchors 630 (i.e., points at which the driver 32 is coupled to the return mechanism 36) and bumper tabs 632 which include contact surfaces 670 that are configured to contact a lower bumper (not shown). The body 510 can include a driver profile 520 (e.g., a surface, such as one with a plurality of V-shaped teeth, that is configured to engage the perimeter of a rotating flywheel as illustrated and described in U.S. patent application Ser. No. 11/586,104) and a cam profile 522 (e.g., a profile with a loading cam and an unloading cam as illustrated and described in U.S. patent application Ser. No. 11/586,104 that is configured to aid in the loading and unloading of the follower with movement of the driver along a driver axis). The driver blade 502 can be configured in any desired manner, such as with a generally rectangular cross-section (taken latterly in a direction perpendicular to the longitudinal axis of the driver blade 502). In the particular example provided, the driver blade 502 has a generally half-moon cross-section having a longitudinally extending key-slot 5300 formed on a top surface of the driver blade 502. The key-slot 5300 can be configured to receive a correspondingly shaped key member 5302 formed on or coupled to the nosepiece assembly 22. The key-slot 5300 and the key member 5302 can cooperate to inhibit rotation of the driver 32 relative to the flywheel 42.

Figure 9:
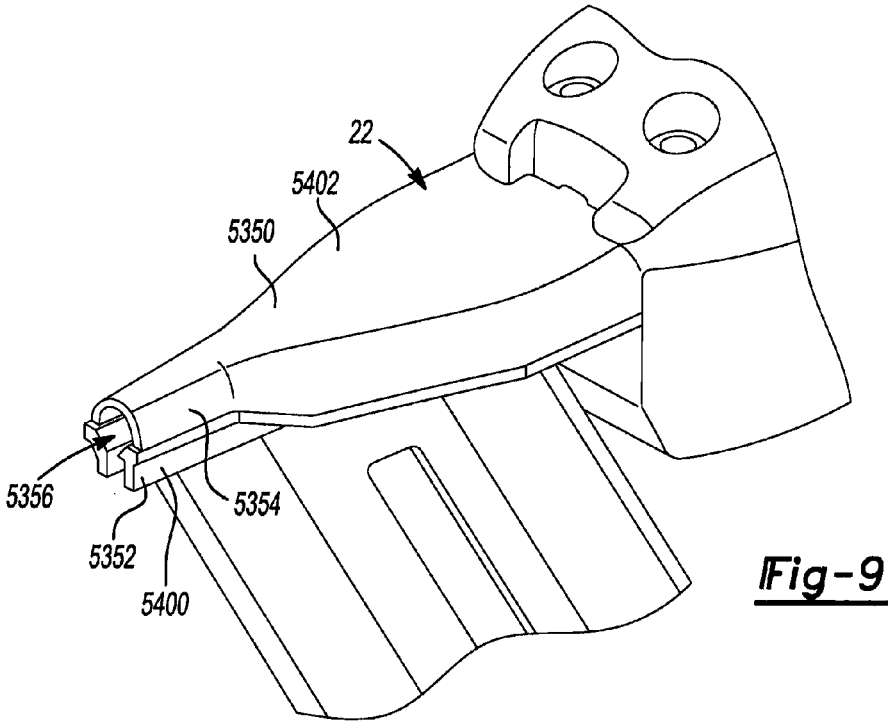
FIG. 9 is a perspective view of a portion of the driving tool of FIG. 1 illustrating the nosepiece in more detail.
Figure 10:
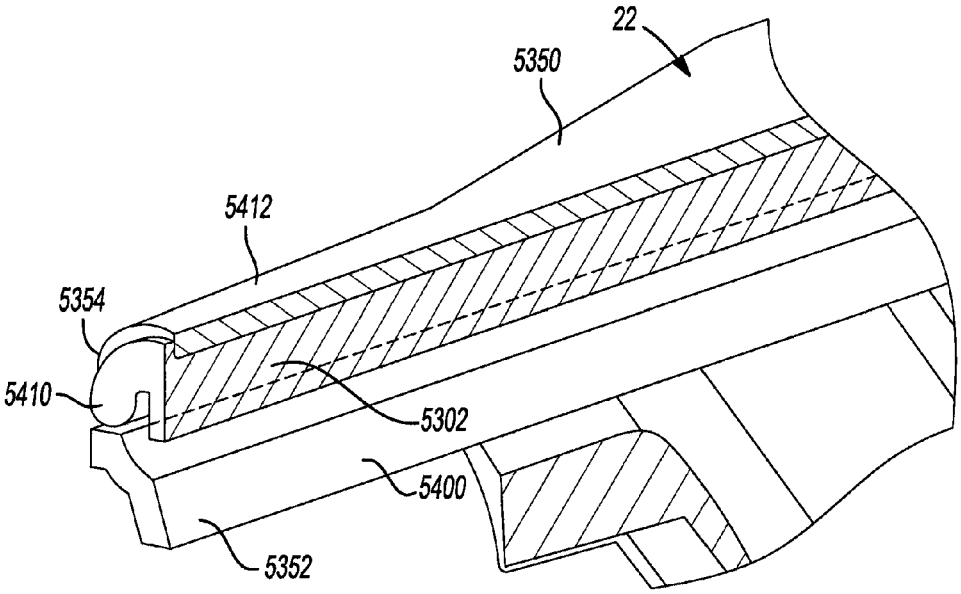
FIG. 10 is a longitudinal section view taken through a portion of the nosepiece.

With reference to FIGS. 8 through 10, the nosepiece assembly 22 can be configured to receive a portion of the upper driver member 500 when the driver 32 is driven forwardly to drive a fastener F (FIG. 1A). In this regard, the nosepiece assembly 22 can include an upper nosepiece member 5350, a lower nosepiece member 5352, and a pair of sidewalls 5354 that can couple the upper nosepiece member 5350 to the lower nosepiece member 5352. The upper and lower nosepiece members 5350 and 5352 and the sidewalls 5354 can cooperate to define a nosepiece cavity 5356 into which a portion of the body 510 of the upper driver member 500 can be received. The key member 5302 can be coupled to the upper nosepiece member 5350 and can extend into the nosepiece cavity 5356. Configuration of the driver 32 and the nosepiece assembly 22 in this manner reduces the distance between the flywheel 42 (FIG. 4) and the nosepiece assembly 22 (relative to the example illustrated and described in U.S. Pat. No. 7,204,403) so that the driving tool 10 (FIG. 1A) can be relatively shorter. The nosepiece assembly 22 can be unitarily formed in a suitable process, such as investment casting, or can be formed as one or more components.

In the example of FIGS. 8 through 10, the nosepiece assembly 22 includes a lower nosepiece structure 5400 and an upper nosepiece structure 5402. The lower nosepiece structure 5400 can be formed of a suitable material, such as steel, in a suitable process, such as investment casting, and can be removably coupled to the backbone 14 (FIG. 2) and the housing and magazine assembly 12 (FIG. 1A) to receive fasteners F (FIG. 1A) from the magazine portion 2406 (FIG. 1A). The upper nosepiece structure 5402 can include a wear plate 5410 and an outer member 5412. The outer member 5412 can be formed of a suitable material, such as die-cast aluminum, and can be coupled to the wear plate 5410 in a suitable manner. In the particular example provided, the wear plate 5410 is formed of steel and is molded into the outer member 5412 (i.e., the outer member 5412 is molded onto the wear plate 5410). As another example, the outer member 5412 can be integrally formed with the backbone 14 (FIG. 1D) and the wear plate 5410 can be formed of steel and fixedly coupled to the outer member 5412 in any desired manner.

Figure 11:
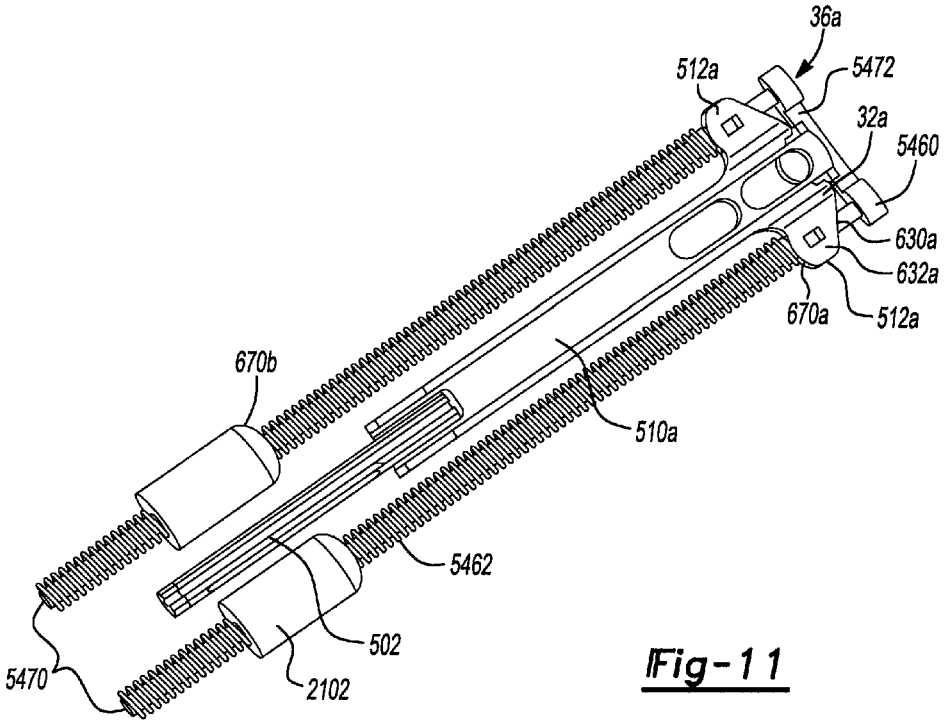
FIG. 11 is a perspective view of a portion of another driving tool constructed in accordance with the teachings of the present disclosure illustrating the return mechanism and driver.
Figure 12:
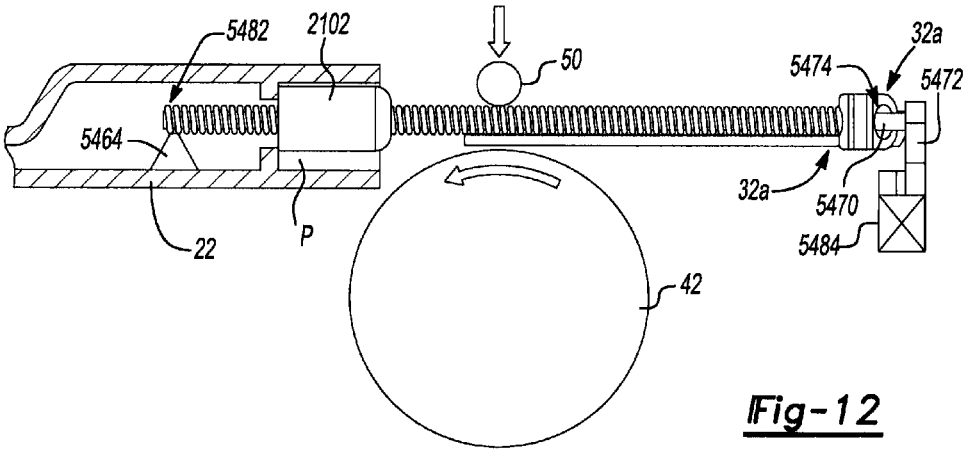
FIG. 12 is a schematic illustration of the driving tool of FIG. 11, illustrating the return mechanism and driver positioned in relation to a nosepiece, a flywheel and a follower.
Figure 13:
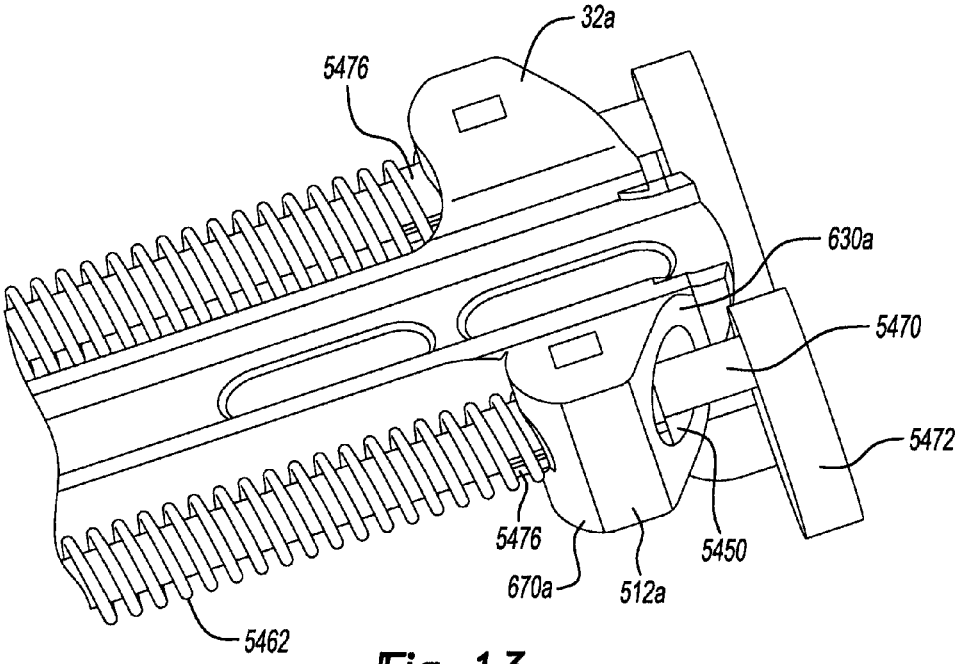
FIG. 13 is an enlarged view of a portion of the return mechanism and driver that are illustrated in FIG. 12.

While the driver 32 has been illustrated and described as employing the projections 515 that are described in U.S. Patent No. 7,204,403, those of skill in the art will appreciate that the driver 32 could be constructed somewhat differently. For example, the driver 32*a* can be configured to include a pair of projections 512*a* as illustrated in FIGS. 11 through 13. The projections 512*a* can extend from the opposite lateral sides of the body 510*a* and can include return anchors 630*a* (i.e., points at which the driver 32 is coupled to the return mechanism 36*a*) and bumper tabs 632*a* which include contact surfaces 670*a* that are configured to contact a lower bumper 2102*a* that can be received into a pocket P formed into the nosepiece assembly 22. Each of the return anchors 630*a* can define an anchor hole 5450, which can extend through an associated one of the projections 512*a* generally parallel to the driver blade 502.

The return mechanism 36*a* can include a rail assembly 5460, a pair of compression springs 5462 and a rail pivot 5464. The rail assembly 5460 can include a pair of rails 5470 an end cap 5472 that can be coupled to an upper end 5474 of the rails 5470. The rails 5470 can be formed of a low friction material, such as hardened steel, and can be employed to guide the driver 32*a* when the driver 32*a* is moved to the returned position. A pair of hollow guide members 5476 can be formed of a lubricious material, such as acetyl, and can be fitted over the rails 5470 and into the anchor holes 5450 to guide the driver 32*a* as the driver 32*a* is moved on the rails 5470. The compression springs 5462 can be received over the rails 5470 on an end opposite the end cap 5472 and can be abutted against the contact surfaces 670*a*. The hollow guide members 5476 can be received into and engage the inner diametrical surface of the compression springs 5462. The compression springs 5462 can be relatively long so as to have a relatively high return force, which can be desirable where the full travel of the driver 32*a* is relatively short and/or where the pusher 5006 (FIG. 1A) applies a relatively high force to the fasteners F (FIG. 1A) in the housing and magazine assembly 12 (FIG. 1A). Moreover, as the compression springs 5462 are relatively long, the stress generated in the compression springs 5462 when the driving tool 10 (FIG. 1A) is operated is relatively low and as such, the compression springs 5462 are anticipated to have a relatively long fatigue life in spite of the dynamic loading that they will experience. Those of skill in the art will appreciate from this disclosure that the pockets P in the nosepiece assembly 22 permit the relatively long rails 5470 and compression springs 5462 to be packaged into the tool without enlarging the size of the tool.

The lower bumpers 2102*a* can be generally hollow and cylindrical in shape with an upper contact surface 670*b* that is defined by a spherical radius. Each of the lower bumpers 2102*a* can be received over an associated one of the compression springs 5462 and can be received in a lower bumper pocket 5480 (FIG. 2) that is formed in the backbone 14 (FIG. 2). The rail pivot 5464 can resiliently support a lower end 5482 of the rails 5470 so as to urge the rails 5470 away from the flywheel 42. Similarly, a compression spring 5484 can be employed to urge the end cap 5472 away from the flywheel 42. Accordingly, it will be appreciated from this disclosure that the rail pivot 5464 and the compression spring 5484 can cooperate to maintain the rails 5470 in a position that spaces the driver 32*a* apart from the flywheel 42. During operation of the driving tool 10 (FIG. 1A), the follower 50 is driven into contact with the cam profile 522 of the driver 32*a* and urges the driver 32*a* downwardly toward the flywheel 42. The rail pivot 5464 and the compression spring 5484 that support the lower and upper ends 5482 and 5474 of the rails 5470 can move toward the flywheel 42 in response to the force applied by the follower 50 to permit the driver profile 520 of the driver 32*a* to engage the flywheel 42.

Figure 16:
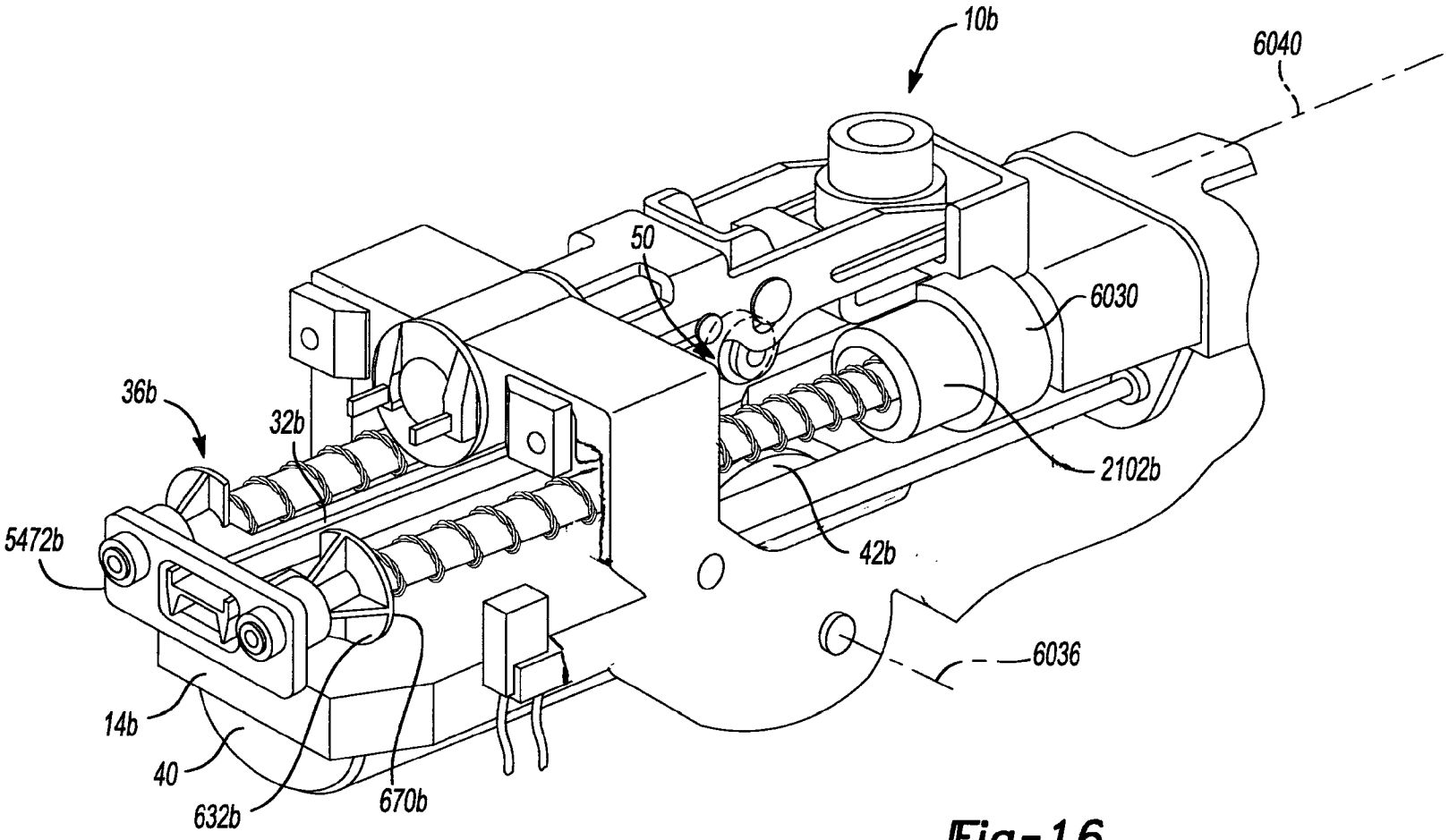
FIG. 16 is a perspective view of a portion of another driving tool constructed in accordance with the teachings of the present disclosure.
Figures 17, 18:
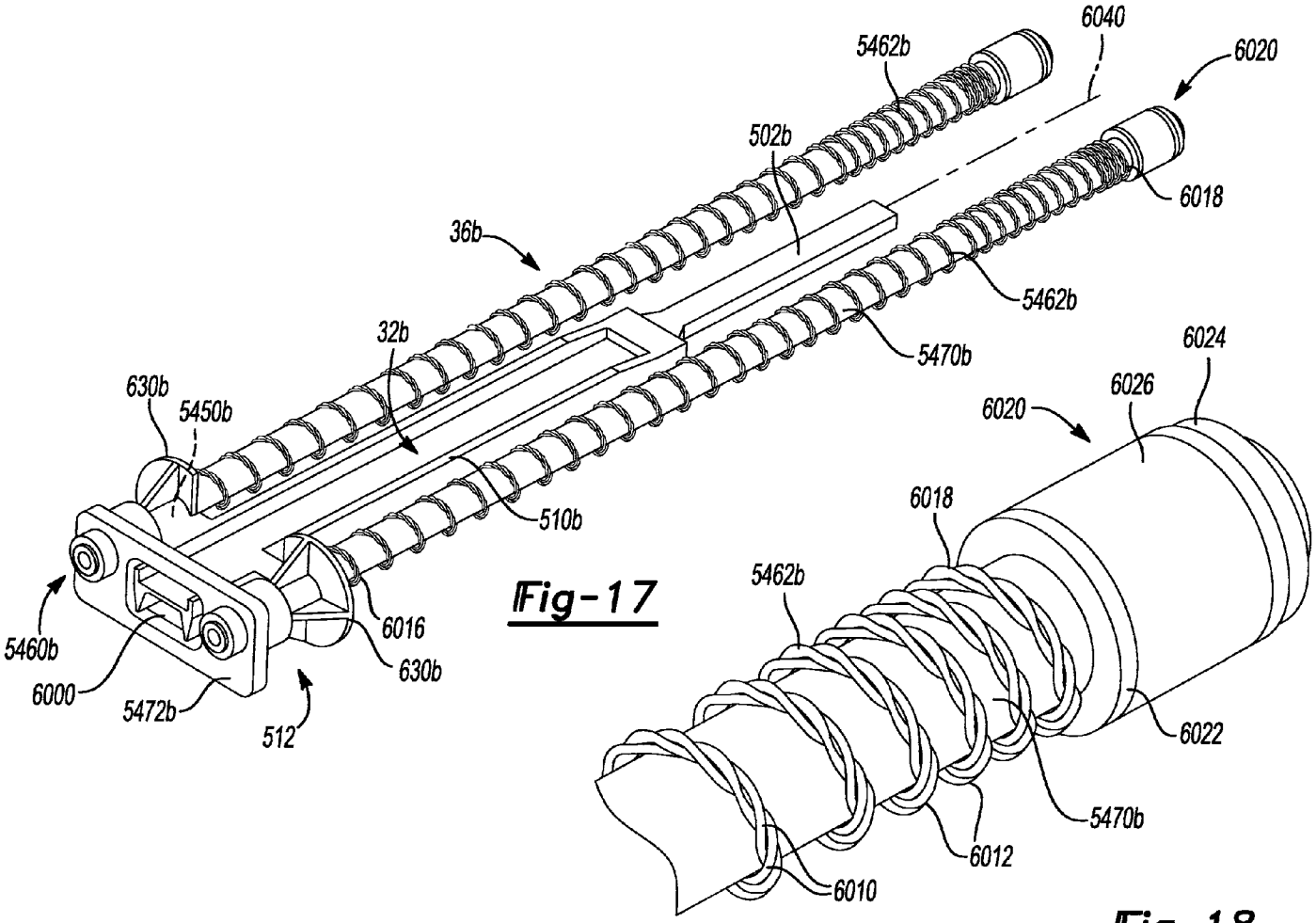
FIG. 17 is a perspective view of a portion of the driving tool of FIG. 16 illustrating the driver and the return mechanism in greater detail.
FIG. 18 is an enlarged portion of FIG. 17.

Another driver constructed in accordance with the teachings of the present disclosure is illustrated in FIG. 16 and identified by reference numeral 10*b*. Except as described herein, the driver 32*b* can be generally similar to the driver 32*a* illustrated in FIGS. 11 through 13 and discussed in detail above. With additional reference to FIGS. 17 and 18, the projections 512*b* of the driver 32*b* can extend from the opposite lateral sides of the body 510*b* and can include integrally-formed return anchors 630*b* and bumper tabs 632*b* that include contact surfaces 670*b* that are configured to contact a lower bumper 2102*b*. Each of the return anchors 630*b* can define an anchor hole 5450*b*, which can extend through an associated one of the projections 512*b* generally parallel to the driver blade 502*b*. The contact surfaces 670*b* can be shaped in a desired manner, but are flat in the particular example provided.

The return mechanism 36*b* can include a rail assembly 5460*b* and a pair of compression springs 5462*b*. The rail assembly 5460*b* can include a pair of rails 5470*b* and an end cap 5472*b* that can be coupled to an upper end 5474*b* of the rails 5470*b*. The rails 5470*b* can be formed of a low friction material, such as hardened steel, and can be received through the anchor holes 5450*b* and employed to guide the driver 32*b* when the driver 32*b* is moved to the returned position. The end cap 5472*b* can include an aperture 6000 through which the driver 32*b* can either extend or be accessed by an upper bumper (not shown), which is coupled to the backbone or frame 14*b* (schematically illustrated in FIG. 16) of the driving tool 10*b*, when the driver 32*b* is moved to the returned position (shown in FIG. 16). It will be appreciated that the upper bumper can include an energy absorbing member so as to dampen the impact forces transmitted to the backbone 14*b* when the driver 32*b* is moved to the returned position.

The compression springs 5462*b* can be received coaxially over the rails 5470*b* on an end opposite the end cap 5472*b* and can be abutted against the return anchors 630*b*. In the particular example provided, the compression springs 5462*b* have ground ends and as such, the return anchors 630*b* have a flat surface against which the compression springs 5462*b* are abutted. It be appreciated, however, that other configurations could be employed in the alternative (e.g., the compression springs 5462*b* could have open or closed ends that are not ground and the surface of the return anchors 630*b* can be at least partly contoured in a helical manner to matingly engage the unground ends of the compression springs 5462*b*).

The compression springs 5462*b* can be configured to provide a relatively long fatigue life in spite of the dynamic loading that they will experience. For example, the compression springs 5462*b* can be formed of several wires 6010 that can be twisted about one another and collectively coiled in a helical manner. For example, each compression spring 5462*b* can be formed of three wires formed of 0.018 inch diameter M4 music wire that can be twisted at a rate of nine (9) turns per inch.

Additionally or alternatively, the compression springs 5462*b* can be configured with a coil pitch (i.e., the distance between adjacent coils 6012 of the compression spring 5462*b*) and at least two different coil pitches can be employed to define each of the compression springs 5462*b*. Each compression spring 5462*b* can employ a first coil pitch at a first end 6016 that is abutted against the return anchor 630*b*, and a second coil pitch at a second end 6018 opposite the first end 6016. The coil pitch can vary between the first and second ends and for example, can become progressively smaller with decreasing distance to the second end. For example, the compression springs 5462*b* can be formed of 0.028 inch M4 music wire, the first coil pitch can be 3.00 mm and the second coil pitch can be 1.20 mm.

Impact absorbers 6020 can be employed in conjunction with the compression springs 5462*b* to further protect the compression springs 5462 from fatigue. In the particular example provided, the impact absorbers 6020 include first and second impact structures 6022 and 6024, respectively and a damper 6026 that can be disposed between the first and second impact structures 6022 and 6024. Each of the first and second impact structures 6022 and 6024 can be formed of a suitable impact-resistant material, such as glass-filled nylon or hardened steel, which can be directly contacted by the compression springs 5462*b*, while the damper 6026 can be formed of a suitable impact absorbing material, such as chlorobutyl rubber. The impact absorbers 6020 can be sleeve-like structures that can be fitted coaxially over an associated one of the rails 5470*b* between the second end 6018 of the compression springs 5462*b* and the backbone or frame 14*b*. The backbone 14*b* can be configured with pockets 6030 to at least partly receive the impact absorbers 6020 but it will be appreciated that the backbone 14*b* and impact absorbers 6020 are not configured to cooperate to maintain the rails 5470*b* in a fixed, non-movable orientation relative to the backbone 14*b*. Rather, the rails 5470*b* are provided with a degree of movement (toward and away from the rotational axis 6036 of the flywheel 42*b*). Configuration in this manner permits the driver 32*b* to be guided during its travel from the returned position to the extended position by the nosepiece 22*b* of the driving tool 10*b* rather than by the rails 5470*b*. It will be appreciated from the foregoing that the nosepiece 22*b* includes an aperture (not shown) that is shaped and sized to correspond to a cross-sectional shape and size of the driver blade 502.

Flywheel Speed Control

Figure 14:
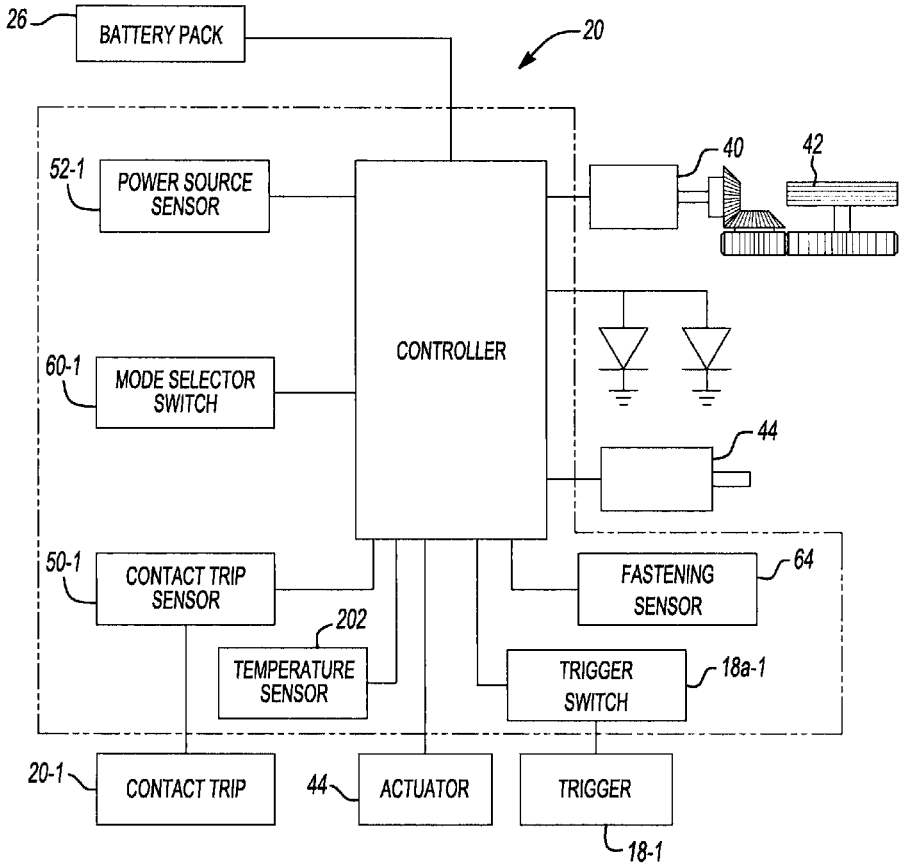
FIG. 14 is a schematic illustration of the driving tool of FIG. 1, illustrating the controller.
Figure 15:
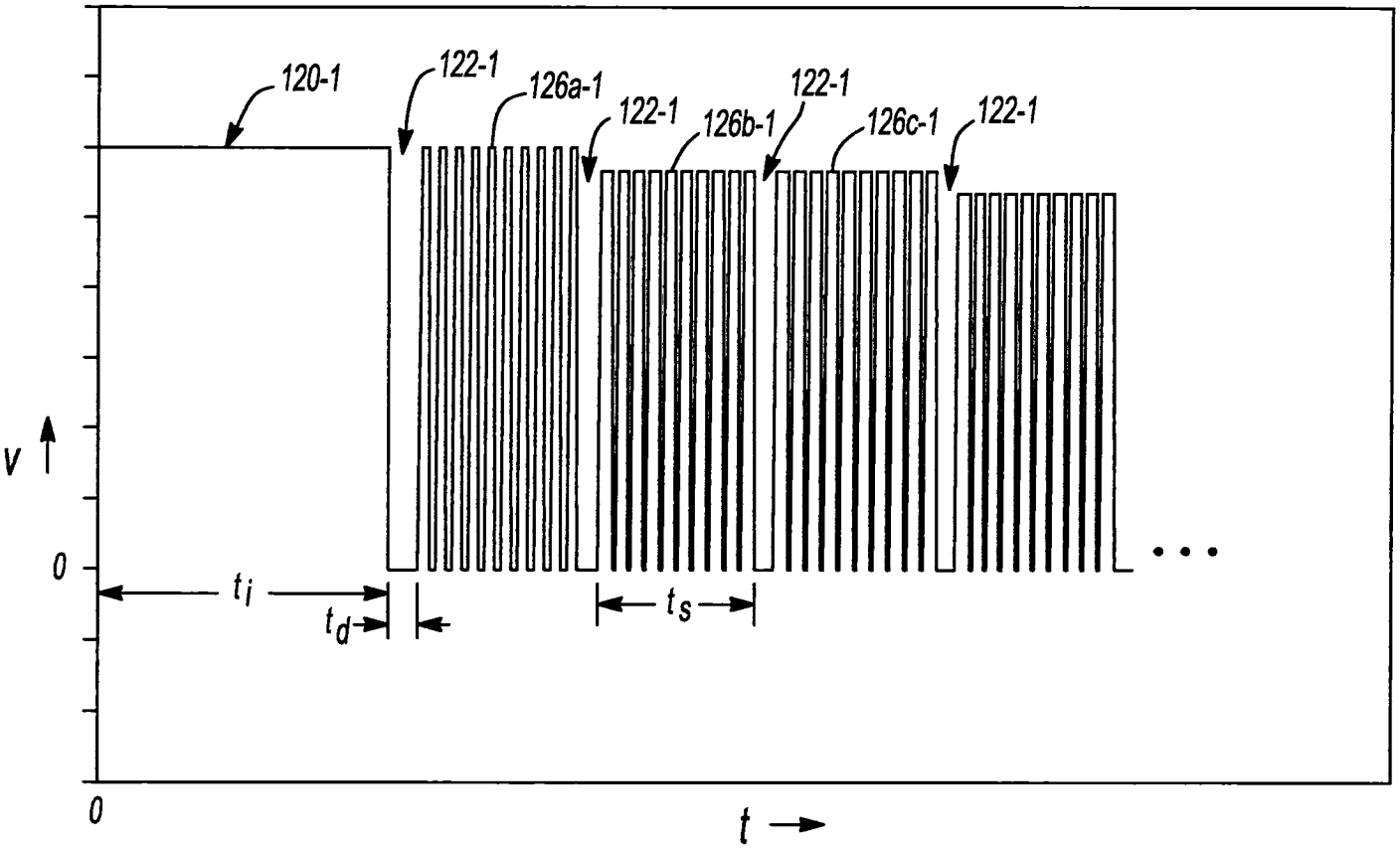
FIG. 15 is a plot illustrating the supply of electrical power to the motor using a pulse-width modulation technique for operation of the driving tool of FIG. 1.

With reference to FIGS. 1A, 14 and 15, the driving tool 10 can include a mode selector switch 60-1. The mode selector switch 60-1 can be employed by the user of the driving tool 10 to set the driving tool 10 into a (first) sequential mode, a bump mode or a second sequential mode. The mode selector switch 60-1, the (first) sequential mode and the bump mode are described in more detail in U.S. patent application Ser. No. 11/095,721 entitled "Fastening Tool With Mode Selector Switch", the disclosure of which is hereby incorporated by reference as if fully set forth in detail herein. In brief, the mode selector switch 60-1 can be a switch that produces a mode selector switch signal that is indicative of a desired mode of operation of the driving tool 10. One mode of operation may be, for example, a sequential fire mode wherein a contact trip 20-1 must first be abutted against a workpiece (so that a contact trip sensor 50-1 generates a contact trip sensor signal) and thereafter a trigger switch 18*a*-1 is actuated to generate a trigger signal. Another mode of operation may be a mandatory bump feed mode wherein the trigger switch 18*a*-1 is first actuated to generate the trigger signal and thereafter the contact trip 20-1 abutted against a workpiece so that the contact trip sensor 50-1 generates the contact trip sensor signal. Yet another mode of operation may be a combination mode that permits either sequential fire or bump feed wherein no particular sequence is required (i.e., the trigger sensor signal and the contact trip sensor signal may be made in either order or simultaneously). In the particular example provided, the mode selector switch 60-1 is a three-position switch that permits the user to select either a first sequential fire mode, the combination mode or a second sequential mode.

The second sequential mode can be generally similar to the first sequential mode, except that the target or desired rotational speed of the flywheel 42 is changed in a desired manner that may be pre-programmed by the manufacturer of the driving tool 10 or selectively pre-programmed by the user of the driving tool 10. In the particular example provided, the first sequential mode and the combination mode are configured such that the control unit 20 controls the power that is provided to the motor 40 to cause the flywheel 42 to rotate at or about a first target speed, while the second sequential mode is configured such that the control unit 20 controls the power that is provided to the motor 40 to cause the flywheel 42 to rotate at or about a second target speed that is greater than the first target speed. Configuration in this manner permits standard-duty operations, such as sheathing and framing, to be performed in the first sequential mode and the combination mode, and heavy-duty operations, such as fastening laminated veneer lumber (LVL) or hard woods, to be performed in the second sequential mode.

In the particular example provided, the control unit 20 can employ pulse width modulation (PWM), DC/DC converters, and precise on-time control to control the operation of the motor 40 and the actuator 44, for example to ensure consistent speed of the flywheel 42 regardless of the voltage of the battery. The control unit 20 can be configured to sense or otherwise determine the actual or nominal voltage of the battery pack 26 at start-up (e.g., when the battery pack 26 is initially installed or electrically coupled to the controller 54). Power can be supplied to the motor 40 over all or a portion of a cycle using a pulse-width modulation technique, an example of which is illustrated in FIG. 15. The cycle, which may be initiated by a predetermined event, such as the actuation of the trigger 18-1, may include an initial power interval 120-1 and one or more supplemental power intervals (e.g., 126*a*-1, 126*b*-1, 126*c*-1). The initial power interval 120-1 may be an interval over which the full voltage of the battery pack 26 may be employed to power the motor 40. The length or duration (ti) of the initial power interval 120-1 may be determined through an algorithm or a look-up table in the memory of the control unit 20 for example, based on the output of the battery pack 26 or on an operating characteristic, such as rotational speed, of a component in the motor assembly 14 and the position of the mode selector switch 60-1. The length or duration (ts) of each supplemental power interval may equal that of the initial power interval 120-1, or may be a predetermined constant, or may be varied based on the output of the battery pack 26 or on an operating characteristic of the drive motor assembly 18.

A dwell interval 122-1 may be employed between the initial power interval 120-1 and a first supplemental power interval 126*a*-1 and/or between successive supplemental power intervals. The dwell intervals 122-1 may be of a varying length or duration (td), but in the particular example provided, the dwell intervals 122-1 are of a constant duration (td). During a dwell interval 122-1, power to the motor 40 may be interrupted so as to permit the motor 40 to "coast". The output of a power source sensor 52-1 may be employed during this time to evaluate the level of kinetic energy in the drive motor assembly 18 (e.g., to permit the control unit 20 to determine whether the drive motor assembly 18 has sufficient energy to drive a fastener) and/or to determine one or more parameters by which the motor 40 may be powered or operated in a subsequent power interval.

In the example provided, the control unit 20 evaluates the back emf of the motor 40 to approximate the speed of the flywheel 42. The approximate speed of the flywheel 42 (or an equivalent thereof, such as the value of the back emf of the motor 40) may be employed in an algorithm or look-up table to determine the duty cycle (e.g., apparent voltage) of the next supplemental power interval. Additionally, if the back emf of the motor 40 is taken in a dwell interval 122-1 immediately after an initial power interval 120-1, an algorithm or look-up table may be employed to calculate changes to the duration (ti) of the initial power interval 120-1. In this way, the value (ti) may be constantly updated as the battery pack 26 is discharged. The value (ti) may be reset (e.g., to a value that may be stored in a look-up table) when a battery pack 26 is initially coupled to the control unit 20. For example, the control unit 20 may set (ti) equal to 180 ms if the battery pack 26 has a nominal voltage of about 18 volts, or to 200 ms if the battery pack 26 has a nominal voltage of about 14.4 volts, or to 240 ms if the battery pack 26 has a nominal voltage of about 12 volts.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A driving tool comprising:

a frame defining a rotational axis and a driver axis;

a motor coupled to the frame;

a flywheel rotatably driven by the motor about the rotational axis;

a rail coupled to the frame;

a driver having a driver body and a driver member, the driver body being configured to engage the flywheel, the driver member being fixedly coupled to the driver body, the driver member being the output member of the driving tool, the driver being slidably mounted on the rail for movement along the driver axis between a returned position and an extended position; and a follower coupled to the frame and movable between a first position, in which the follower drives the driver body into engagement with the flywheel to transfer energy from the flywheel to the driver to propel the driver relative to the frame along the driver axis, and a second position in which the follower, the driver and the flywheel are not engaged to one another.

2. The driving tool of claim 1, wherein a return spring is mounted on the rail, the return spring biasing the driver toward the returned position.

3. The driving tool of claim 2, wherein the return spring is a helical coil spring, wherein adjacent coils of the helical coil spring are spaced apart by a coil pitch and wherein at least two coil pitches are employed to define the helical coil spring.

4. The driving tool of claim 3, wherein a first end of the helical coil spring adjacent the driver employs a first coil pitch, wherein a second, opposite end of the helical coil spring employs a second coil pitch and wherein the first coil pitch is larger than the second coil pitch.

5. The driving tool of claim 4, wherein the coil pitch varies between the first coil pitch and the second coil pitch between the first and second ends.

6. The driving tool of claim 5, wherein the coil pitch progressively decreases with decreasing distance to the second end.

7. The driving tool of claim 2, wherein the return spring is a helical coil spring that comprises a plurality of twisted wires.

8. The driving tool of claim 2, further comprising an impact absorber disposed between the frame and the return spring.

9. The driving tool of claim 8, wherein the impact absorber is received over the rail.

10. The driving tool of claim 1, further comprising a nosepiece into which the driver is partly received, wherein the rail is movably coupled to the frame such that the nosepiece guides the driver as the driver is moved from the returned position to the extended position.

11. The driving tool of claim 10, further comprising a magazine coupled to the nosepiece, the magazine being configured to hold a plurality of fasteners that are sequentially dispensed into the nosepiece, the driver member being configured to sequentially drive the fasteners through the nosepiece into a workpiece.

12. The driving tool of claim 1, wherein the driver member is a blade.

13. The driving tool of claim 1, wherein the driver body and the driver member are two discrete components that are assembled to one another.

14. The driving tool of claim 1, wherein the rail is pivotably coupled to the frame.

15. A driving tool comprising:

a frame defining a rotational axis and a driver axis;

a motor coupled to the frame;

a flywheel rotatably driven by the motor about the rotational axis;

a rail pivotably coupled to the frame;

a driver having a driver body and a driver member, the driver body being configured to engage the flywheel, the driver member being fixedly coupled to the driver body, the driver member being the output member of the driving tool, the driver being slidably mounted on the rail for guided movement on the rail between a returned position and an extended position; and a follower coupled to the frame and movable between a first position, in which the follower drives the driver body into engagement with the flywheel when the driver is in the returned position to transfer energy from the flywheel to the driver to thereby propel the driver relative to the frame along the driver axis toward the extended position, and a second position in which the follower, the driver and the flywheel are not engaged to one another.

16. The driving tool of claim 15, wherein a return spring is mounted on the rail, the return spring biasing the driver toward the returned position.

17. The driving tool of claim 16, wherein the return spring is a helical coil spring, wherein adjacent coils of the helical coil spring are spaced apart by a coil pitch and wherein at least two coil pitches are employed to define the helical coil spring.

18. The driving tool of claim 17, wherein a first end of the helical coil spring adjacent the driver employs a first coil pitch, wherein a second, opposite end of the helical coil spring employs a second coil pitch and wherein the first coil pitch is larger than the second coil pitch.

19. The driving tool of claim 18, wherein the coil pitch varies between the first coil pitch and the second coil pitch between the first and second ends.

20. The driving tool of claim 19, wherein the coil pitch progressively decreases with decreasing distance to the second end.

21. The driving tool of claim 16, wherein the return spring is a helical coil spring that comprises a plurality of twisted wires.

22. The driving tool of claim 16, further comprising an impact absorber disposed between the frame and the return spring.

23. The driving tool of claim 22, wherein the impact absorber is received over the rail.

24. The driving tool of claim 15, further comprising a nosepiece into which the driver is partly received, wherein the rail is movably coupled to the frame such that the nosepiece guides the driver as the driver is moved from the returned position to the extended position.

25. The driving tool of claim 24, further comprising a magazine coupled to the nosepiece, the magazine being configured to hold a plurality of fasteners that are sequentially dispensed into the nosepiece, the driver member being configured to sequentially drive the fasteners through the nosepiece into a workpiece.

26. The driving tool of claim 15, wherein the driver member is a blade.

27. The driving tool of claim 15, wherein the driver body and the driver member are two discrete components that are assembled to one another.

28. A driving tool comprising:

a frame defining a rotational axis and a driver axis;

a nosepiece coupled to the frame;

a motor coupled to the frame;

a flywheel rotatably driven by the motor about the rotational axis;

a rail pivotably coupled to the frame;

a driver having a driver body and a driver member fixed to the driver body, the driver being mounted on the rail such that the rail guides the driver for movement between a returned position and an extended position, the driver member being received in the nosepiece when the driver is in the extended position, the driver being slidably mounted on the rail for guided movement on the rail between a returned position and an extended position;

a follower coupled to the frame and movable between a first position, in which the follower drives the driver body into engagement with the flywheel when the driver is in the returned position to transfer energy from the flywheel to the driver to thereby propel the driver relative to the frame along the driver axis toward the extended position, and a second position in which the follower, the driver and the flywheel are not engaged to one another; and a magazine coupled to the nosepiece, the magazine being configured to hold a plurality of fasteners that are sequentially dispensed into the nosepiece, the driver member being configured to sequentially drive the fasteners through the nosepiece into a workpiece.

* * * * *